US008540121B2

(12) United States Patent
Walters et al.

(10) Patent No.: US 8,540,121 B2
(45) Date of Patent: Sep. 24, 2013

(54) DISPENSING ACTUATOR WITH FLIP-OPEN LID

(75) Inventors: Peter J. Walters, Barrington, IL (US); Jason A. Ksiazk, Arlington Heights, IL (US); Sean H. Cho, Elgin, IL (US); Gerald J. Marquardt, Elgin, IL (US); Jonathan D. Werner, Algonquin, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 1108 days.

(21) Appl. No.: 12/459,750

(22) Filed: Jul. 7, 2009

(65) Prior Publication Data

US 2011/0006083 A1 Jan. 13, 2011

(51) Int. Cl.
*B65D 83/22* (2006.01)

(52) U.S. Cl.
USPC ..... 222/182; 222/402.13; 222/153.1

(58) Field of Classification Search
USPC ..... 222/153.11, 402.11, 402.13, 153.1, 222/562, 182, 556, 553, 321.7, 321.9; 220/263, 220/254.3; 215/237, 235
See application file for complete search history.

(56) References Cited

U.S. PATENT DOCUMENTS

| | | | | |
|---|---|---|---|---|
| 3,308,835 | A * | 3/1967 | Silverberg et al. | 220/263 |
| 3,770,168 | A * | 11/1973 | Sagarin | 222/182 |
| 3,792,802 | A * | 2/1974 | Gores | 222/402.13 |
| 4,010,875 | A | 3/1977 | Babiol | |
| 4,053,090 | A * | 10/1977 | Kelly et al. | 222/402.13 |
| 4,353,483 | A * | 10/1982 | Pehr | 222/153.02 |
| 4,625,898 | A | 12/1986 | Hazard | |
| 4,901,882 | A | 2/1990 | Goncalves | |
| 5,092,493 | A * | 3/1992 | Pehr | 222/153.02 |
| 5,131,558 | A | 7/1992 | Hiromori | |
| 5,193,707 | A | 3/1993 | Mizumura | |
| 5,390,828 | A | 2/1995 | Gross | |

(Continued)

FOREIGN PATENT DOCUMENTS

| | | | |
|---|---|---|---|
| EP | 0547978 | * | 6/1993 |
| EP | 1 316 510 B1 | | 12/2007 |

(Continued)

OTHER PUBLICATIONS

English Translation of WO 2008/125416, published Oct. 23, 2008.*

(Continued)

*Primary Examiner* — Paul R Durand
*Assistant Examiner* — Robert Nichols, II
(74) *Attorney, Agent, or Firm* — Wood, Phillips, Katz, Clark & Mortimer

(57) ABSTRACT

A dispensing actuator for use on a container having pressurized contents is configured for convenient one-handed manipulation and use by consumers. The dispensing actuator includes a hingedly moveable flip-open lid, and a laterally moveable opening element, which can be manipulated so that the opening element cooperates with the lid to move the lid from a closed position to an opened position. The present dispensing actuator further includes an inner, downwardly deflectable actuating element, operatively connected with a dispensing valve of the associated container. Resilient, downward deflection of the actuating element, after opening of the dispensing actuator lid, permits the contents of the container to be conveniently dispensed. In one embodiment, the contents of the container are dispensed generally laterally of the dispensing actuator, while in alternate embodiments, the container's contents are dispensed generally upwardly, through the actuating element of the dispensing actuator.

15 Claims, 9 Drawing Sheets

(56) References Cited

U.S. PATENT DOCUMENTS

| | | | | |
|---|---|---|---|---|
| 5,392,961 | A * | 2/1995 | Starrett | 222/153.14 |
| 5,460,288 | A | 10/1995 | Balzeau | |
| 5,573,127 | A | 11/1996 | Takahashi | |
| 5,582,316 | A * | 12/1996 | Masayoshi et al. | 220/264 |
| 5,647,498 | A * | 7/1997 | Kaneko | 220/263 |
| 5,752,612 | A | 5/1998 | Fritzsche et al. | |
| 5,868,265 | A | 2/1999 | Kobayashi | |
| 5,873,476 | A * | 2/1999 | Takahashi et al. | 215/237 |
| 6,834,769 | B2 | 12/2004 | Takahashi et al. | |
| 6,908,017 | B2 | 6/2005 | Mineau et al. | |
| 6,991,138 | B2 * | 1/2006 | Marroncles | 222/402.11 |
| 7,000,792 | B2 | 2/2006 | Arai | |
| 7,278,554 | B2 | 10/2007 | Armstrong | |
| 7,611,024 | B2 | 11/2009 | Yamanaka et al. | |
| 7,861,894 | B2 | 1/2011 | Walters et al. | |
| 8,141,731 | B2 * | 3/2012 | Mazurkiewicz et al. | 215/237 |
| 2005/0023285 | A1 | 2/2005 | Keung | |
| 2005/0061014 | A1 | 3/2005 | Cannan | |
| 2009/0255958 | A1 * | 10/2009 | Santoni et al. | 222/321.1 |

FOREIGN PATENT DOCUMENTS

| | | | |
|---|---|---|---|
| JP | 59-148708 | | 10/1984 |
| JP | 6-15844 | | 4/1994 |
| JP | 6-76094 | | 10/1994 |
| JP | 7-9747 | | 2/1995 |
| JP | 8048354 | | 2/1996 |
| TW | 276239 | | 9/1984 |
| WO | WO 02/22456 | A1 | 3/2002 |
| WO | WO2008125416 | * | 10/2008 |

OTHER PUBLICATIONS

English Translation of EP 0547978, published Jun. 6, 1993.*

Timothy M. Mazurkiewicz et al. U.S. Appl. No. 12/154,748, filed May 27, 2008.

Daniel G. Schantz et al. U.S. Appl. No. 12/313,979, filed Nov. 26, 2008.

International Search Report and Written Opinion from PCT/US2010/01550.

"International Search Report and the Written Opinion of the International Searching Authority, or the Declaration" with a completion date of May 27, 2009 and a date of mailing of Jul. 2, 2009 for PCT/US2009/02324.

U.S. Appl. No. 12/154,748, filed May 27, 2008.

European Examination Report for corresponding application No. EP 09 755 210.3.

* cited by examiner

DISPENSING ACTUATOR WITH FLIP-OPEN LID

TECHNICAL FIELD

This invention relates to a dispensing actuator for dispensing a fluent substance or product. The invention is more particularly related to a dispensing actuator that is especially suitable for a hand-held container and that has a flip-open lid that can be opened and closed. Notably, the dispensing actuator includes an actuating element positioned beneath the flip-open lid of the dispensing actuator, which arrangement prevents inadvertent actuation, but permits one-handed operation for the convenience of the user. The actuating element can be operated by downward deflection to operate a dispensing valve of the container, to thereby dispense product from the container through a dispensing orifice of the dispensing actuator. In one form, the orifice directs product generally laterally of the dispensing actuator, while in further embodiments, the dispensing orifice can be provided in the actuating element itself, so that product is dispensed generally upwardly of the dispensing actuator.

BACKGROUND OF THE INVENTION AND TECHNICAL PROBLEMS POSED BY THE PRIOR ART

Finger-operable dispensers are typically adapted to be incorporated in dispensing systems mounted on handheld containers that are commonly used for fluent substances or products. Some dispensers are designed for use with a valve assembly, and have a suitable discharge structure to produce a foam, mousse, or atomized spray. A dispensing system comprising such a valve assembly and cooperating dispenser is typically used for dispensing cosmetic products or other personal care products such as hairspray, deodorant or antiperspirant, body sprays, etc., as well as institutional, industrial, and household products.

Dispensing systems comprising a valve assembly and cooperating dispenser are typically mounted at the top of the associated container, such as a metal can containing a pressurized product. The dispenser typically includes an external actuating element that is operatively connected to the valve assembly, and that provides a dispensing orifice from which the product can be dispensed to a target area.

For some applications, it can be desirable to provide a dispensing actuator which facilitates push-button or like actuation of the valve assembly of the associated container. While convenient use is thus facilitated, at the same time, it is desirable to prevent inadvertent actuation and dispensing, and thus the provision of a removable lid or cover, to shield the push-button from inadvertent actuation, can be desirable.

To facilitate convenient use of dispensing actuators for use on associated containers, it is known to provide such dispensing actuator constructions with flip-open lids, typically provided as an integral portion of the dispensing actuator, such as by the provision of a unitary, living hinge or the like. Such arrangements desirably preclude the need for a separate lid or cover which can inadvertently be lost or otherwise separated from the remainder of the dispensing actuator structure.

More recently, efforts have been made to provide such flip-open lid dispensing actuators with push-button actuation, by which simple manipulation of a button on the dispensing actuator urges the flip-open lid from a closed position to an open position. Such arrangements can be particularly desirable, such as for hair care or other personal care products, since a container can be easily grasped in one hand, and the push-button of the dispensing actuator actuated to open the flip-open lid, and thus facilitate convenient dispensing of the contents of the container.

Notably, the present invention is directed to a dispensing actuator for use on a container having a dispensing valve assembly, with the present dispensing actuator desirably configured to permit push-button opening of a flip-open lid of the dispensing actuator, and subsequent actuation of the valve assembly of the container for convenient dispensing of the container's contents.

SUMMARY OF THE INVENTION

In accordance with the present invention, an improved dispensing actuator is provided for a container that has a dispensing valve (either a separate valve or a pump that defines, or functions as, a valve) through which the contents of the container can be conveniently dispensed by one-handed operation. The dispensing actuator includes a flip-open lid, a push-button opening element which can be manipulated to open the lid, and an inner actuating element which operates the dispensing valve of the container. After the lid is opened by manipulation of the opening element, the actuating element can be downwardly deflected to operate the valve and dispense product from the container. In certain disclosed embodiments, the actuating element is manipulated by finger pressure thereon to operate the dispensing valve, while in an alternate embodiment, the actuating element is configured for engagement by the opening element, so that continued pressure on the opening element after it opens the dispensing actuator lid results in downward deflection of the actuating element for dispensing product.

A dispensing actuator embodying the principles of the present invention is configured for use with an associated container having a dispensing valve for dispensing a fluent product. In accordance with the presently preferred embodiments, the dispensing valve includes an outwardly projecting, moveable, product-dispensing valve stem that is normally biased from an actuated, open dispensing position to a closed position. Valve stem movement to open the valve may be axially of the valve stem, generally inwardly of the container, or generally angular movement—depending on the valve type or design.

In a typical embodiment, the associated container includes an annular shoulder, and a mounting cup secured to the annular shoulder, with the dispensing valve mounted on the mounting cup. Typically, the contents of the container are pressurized, so that movement of the valve stem acts to dispense the pressurized contents of the container.

In accordance with the illustrated embodiments, the present dispensing actuator includes a dispensing actuator base for extending from the container at the dispensing valve thereof. A presently preferred form of the dispensing actuator base includes (1) a deck, and (2) a skirt depending from the deck.

The present dispensing actuator further includes a flip-open lid configured for movement between: (1) a closed position, and (2) an opened position to permit dispensing of the substance from the associated container. Preferably, the lid includes a hinge for connecting the lid to the dispensing actuator base.

Convenient manipulation of the lid of the dispensing actuator is facilitated by the provision of an opening element mounted on the dispensing actuator base for generally lateral movement with respect thereto from a closed position to an opened position. The opening element is engageable with the lid of the dispensing actuator, so that generally lateral movement of the opening element from its closed position to the opened position moves the lid from the closed position thereof to the opened position thereof.

In accordance with the present invention, the present dispensing actuator further includes an actuating element mounted on, or otherwise connected with, the dispensing actuator base. If the actuator base has a deck, the actuating element may be disposed generally adjacent to the deck. The actuating element is accessible when the lid of the dispensing actuator is in its opened position. The actuating element is preferably formed unitarily, as one-piece, with the dispensing actuator base, but is resiliently movable or deflectable for effecting operation of the dispensing valve of the associated container. In particular, the actuating element is configured to be downwardly deflectable, with such downward deflecting movement of the actuating element operating the dispensing valve for opening the valve, to thereby permit dispensing of the fluent substance within the container through a dispensing orifice defined by the dispensing actuator.

In accordance with the illustrated embodiments, the opening element of the present dispensing actuator includes a proximal, button portion configured for manipulation to urge the opening element from the closed position toward the opened position thereof. The opening element includes at least one distal, pusher portion generally opposite the proximal portion of the opening element. The distal pusher portion is preferably engageable with the lid hinge of the dispensing actuator as the opening element moves from its closed position to its opened position, to thereby move the lid from its closed position to the opened position thereof. The opening element is preferably positioned generally beneath the deck of the dispensing actuator base.

In the illustrated embodiments, the actuating element of the dispensing actuator is mounted on the dispensing actuator base by a hinge region which provides deflectable, generally hinging movement of the actuating element about in axis which is generally parallel to the hinging axis of the lid of the dispensing actuator.

In one illustrated embodiment, the dispensing actuator base defines an internal passageway that communicates with the dispensing orifice of the dispensing actuator, and that can be joined in fluid communication with the stem of the dispensing valve. By this arrangement, actuation of the dispensing valve by deflection of the actuating element permits the pressurized fluent product within the container to flow through the valve stem, and into the passageway for dispensing out of the dispensing orifice.

In this embodiment, the passageway extends generally at a right angle to an axis defined by the product-dispensing stem of the dispensing valve, such that product is dispensed generally laterally of the dispensing actuator. To this end, the hinge for the dispensing actuator lid includes a pair of spaced-apart hinge elements, with the dispensing orifice being positioned on the dispensing actuator base to direct the substance being dispensed generally between the hinge elements. In this embodiment, the opening element of the dispensing actuator has a generally bifurcated configuration, extending generally along opposite sides of the internal passageway, with a pair of distal pusher portions respectively engageable with the pair of spaced-apart hinge elements.

In alternate illustrated embodiments, the actuating element of the dispensing actuator includes the dispensing orifice, with the actuating element defining a valve stem pocket communicating with the dispensing orifice. The product-dispensing valve stem is positionable in the pocket when the dispensing actuator is fitted to the associated container, so that downward deflection of the actuating element acts to move the valve stem, and thereby dispense the fluent product within the container through the actuating element. In these embodiments, the substance is dispensed generally upwardly of the dispensing actuator.

In one embodiment, the actuating element defines a finger pad for manipulation to downwardly deflect the actuating element for dispensing the product. In an alternate embodiment, the actuating element defines a cam surface engageable by the opening element of the dispensing actuator as the opening element is moved from its closed position toward the opened position thereof. By this action, the opening element cooperates with the actuating element to downwardly deflect the actuating element, and thereby dispense product, again, generally upwardly through the actuating element. Thus, opening of the dispensing actuator lid, and dispensing of product, can be effected without the user repositioning their finger from the opening element to the actuating element.

The dispensing actuator components can be designed for easily accommodating the assembly of the components during manufacture of the dispensing actuator.

The dispensing actuator can be provided with a design that accommodates efficient, high quality, large volume manufacturing techniques with a reduced product reject rate.

The dispensing actuator can optionally be designed to accommodate its use with a variety of conventional or special containers having a variety of conventional or special container finishes, including conventional threaded, or snap-fit, attachment configurations.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

While this invention is susceptible of embodiment in many different forms, this specification and the accompanying drawings disclose specific forms as examples of the invention. The invention is not intended to be limited to the embodiments so described, however. The scope of the invention is pointed out in the appended claims.

For ease of description, many of the figures illustrating the invention show the dispensing actuator as including a separate, removable, dispensing actuator in the typical orientation that the dispensing actuator would have at the top of a container when the container is stored upright on its base, and terms such as upper, lower, horizontal, etc., are used with reference to this position. It will be understood, however, that the dispensing actuator of this invention may be manufactured, stored, transported, used, and sold in an orientation other than the orientations described.

The dispensing actuator of this invention is suitable for use with a variety of conventional or special fluent product dispensing systems, including packages, articles, and other dispensing equipment or apparatus, the details of which, although not fully illustrated or described, would be apparent to those having skill in the art and an understanding of such fluent product dispensing systems. Such a fluent product dispensing system, or portion thereof, with which the inventive dispensing actuator cooperates is hereinafter simply referred to as a "container." The particular container, per se, that is illustrated and described herein forms no part of, and therefore is not intended to limit, the present invention. It will also be understood by those of ordinary skill that novel and non-obvious inventive aspects are embodied in the described exemplary dispensing actuator system alone.

While the present dispensing actuator has been disclosed in association with a dispensing valve of a container having pressurized contents, it will be understood that the present actuator can readily be configured for operation of a valve stem of an associated dispensing pump. For such an application, the present actuator can be configured to provide sufficient, downwardly deflectable movement of an actuating element of the dispensing actuator to permit dispensing actuation of the associated pump. Thus, reference herein to an outwardly projecting, movable, product-dispensing stem of a dispensing valve will be understood to include reference to the product-dispensing stem of a dispensing pump, which may incorporate a valve.

The Dispensing Actuator on a Container

Figure 1:
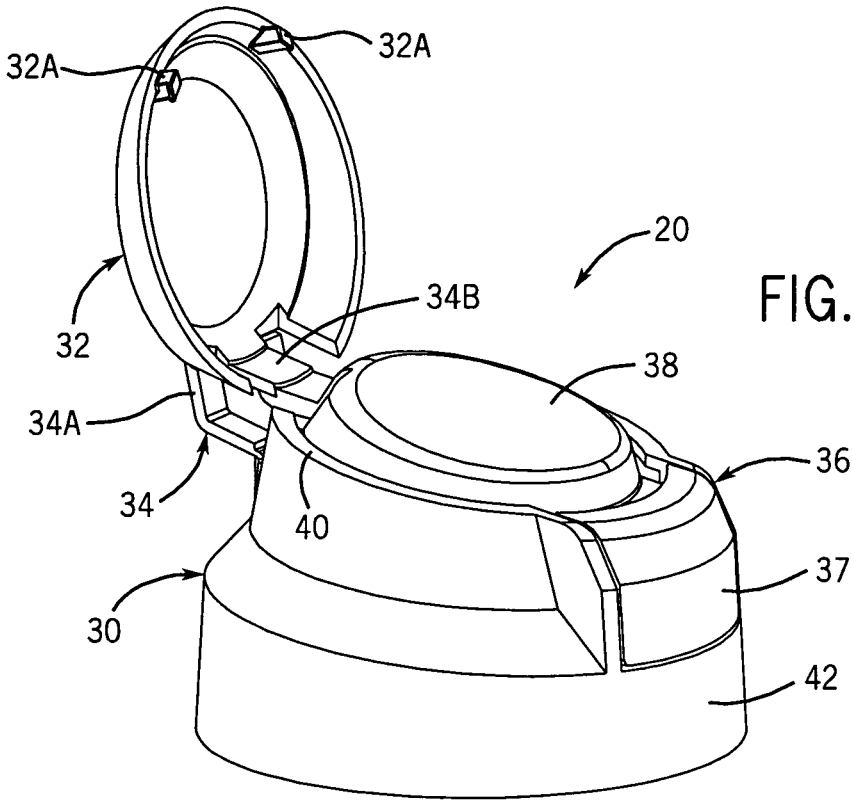
FIG. 1 is an isometric view of a dispensing actuator embodying the principles of the present invention, with a flip-open lid of the dispensing actuator shown in an opened position.
Figure 2:
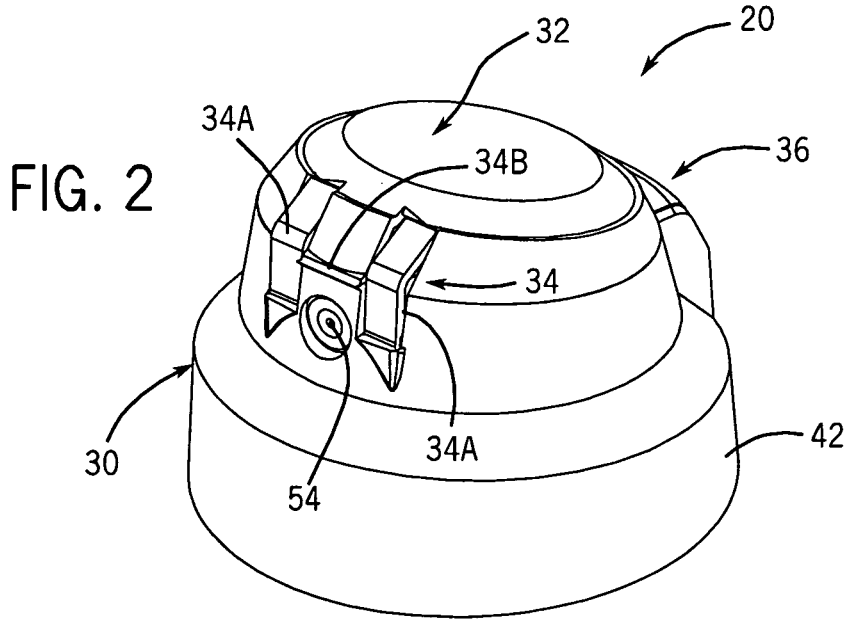
FIG. 2 is a further isometric view of the present dispensing actuator, shown from the opposite side thereof, with the flip-open lid of the dispensing actuator shown in a closed position.

A first embodiment of a dispensing actuator of the present invention is illustrated in the figures and is designated generally therein by reference number 20 in FIG. 1. In the embodiment illustrated, the dispensing actuator 20 is provided in the form of a separate dispensing actuator 20 which is adapted to be mounted or installed on a container 22 that would typically contain a fluent substance or product (see FIG. 4).

Figure 4:
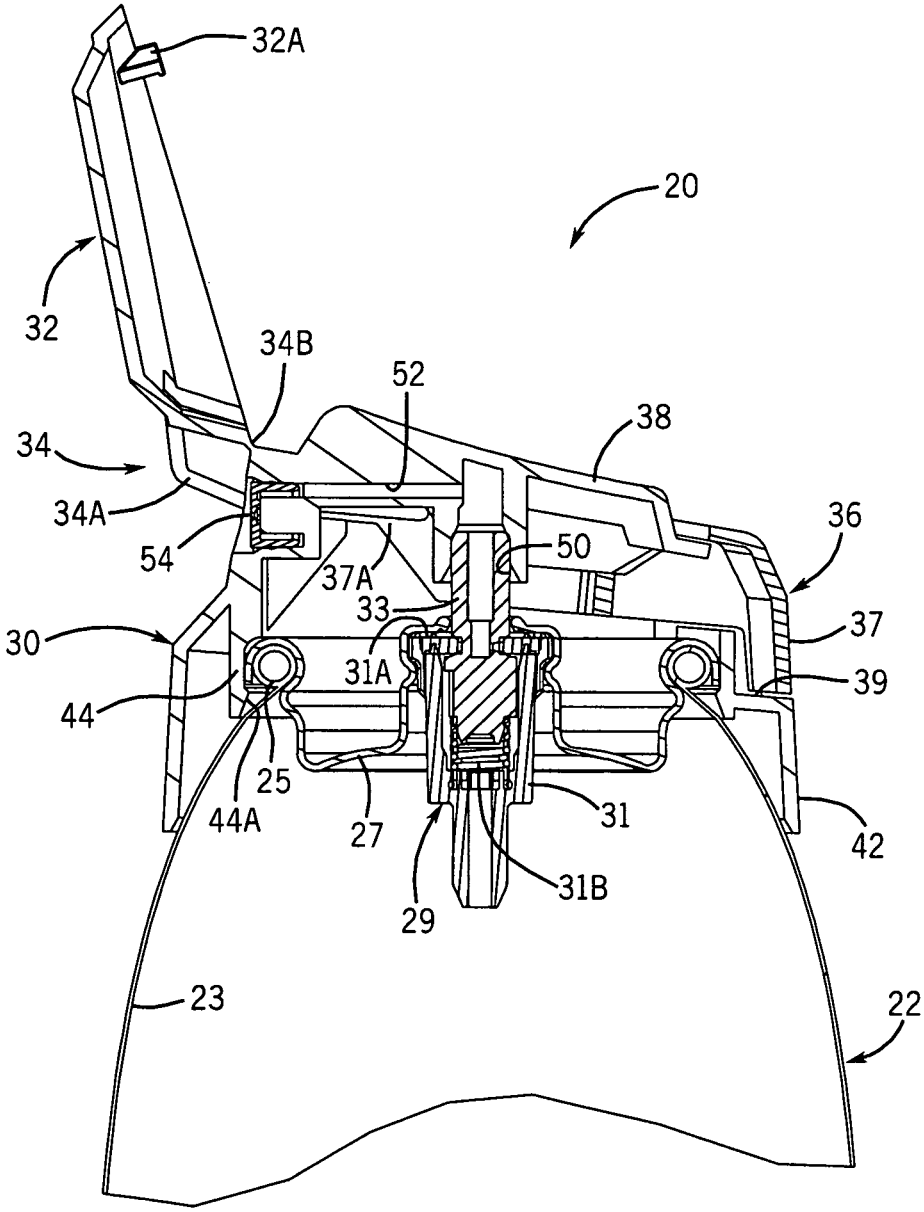
FIG. 4 is a cross-sectional view of the present dispensing actuator, shown with the dispensing valve and mounting cup of FIG. 3 in position on an associated container.
Figure 4A:
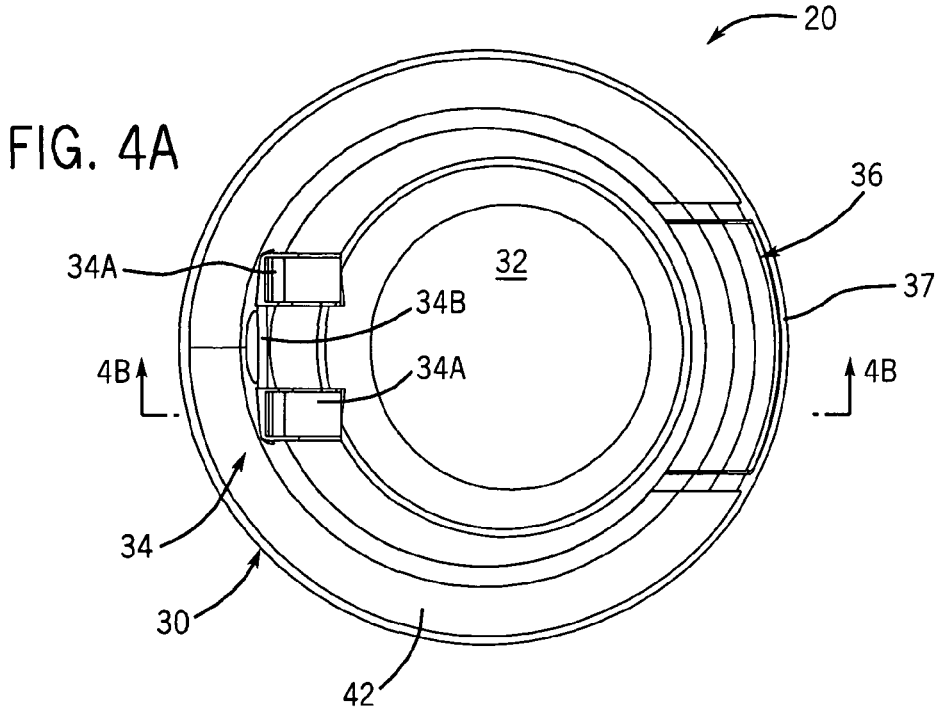
FIG. 4A is a top plan view of the present dispensing actuator, showing the lid thereof in a closed position.
Figure 4B:
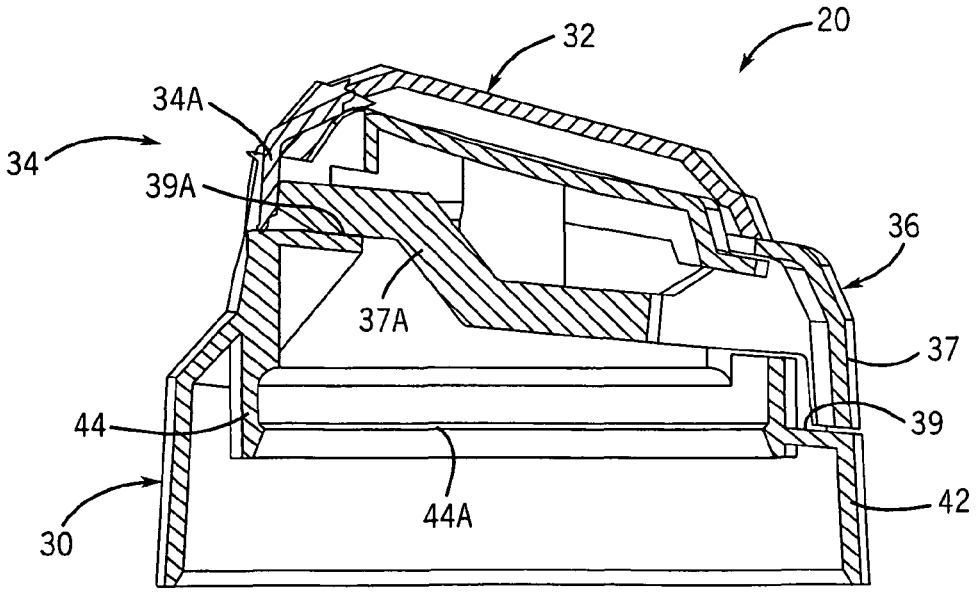
FIG. 4B is a cross-sectional view of the present dispensing actuator taken along line B-B of FIG. 4A.
Figure 4C:
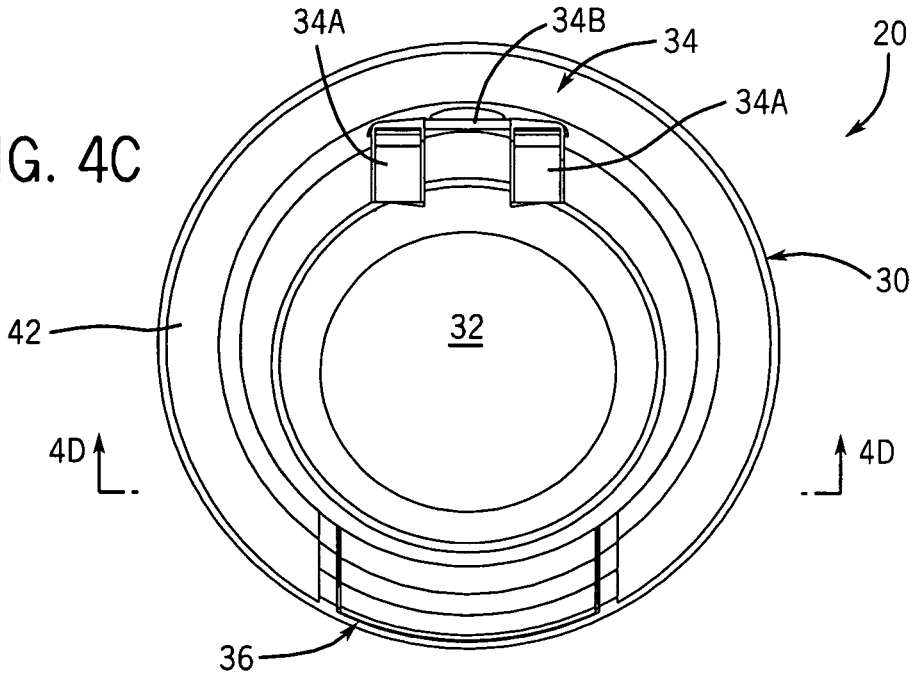
FIG. 4C is a top plan view of the present dispensing actuator similar to FIG. 4A.
Figure 4D:
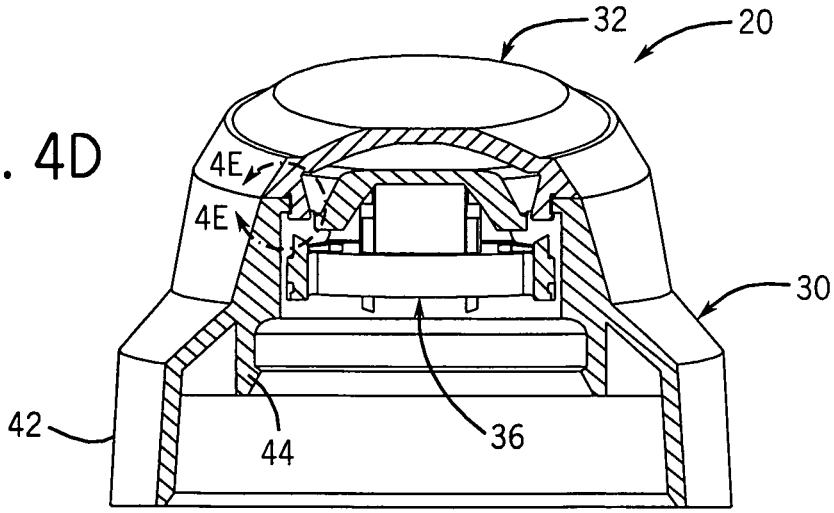
FIG. 4D is a cross-sectional view of the present dispensing actuator taken along line D-D of FIG. 4C.
Figure 4E:
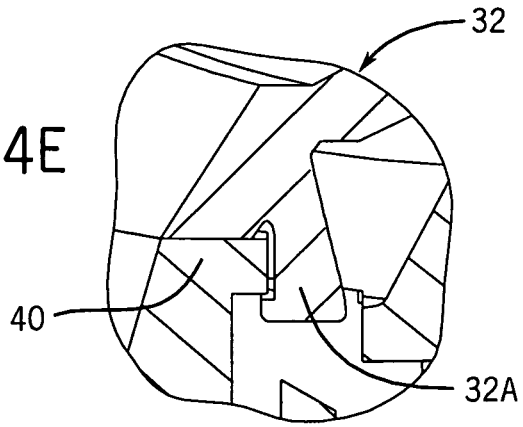
FIG. 4E is a relatively enlarged, fragmentary, cross-sectional view of the region 4E-4E in FIG. 4D.
Figure 5:
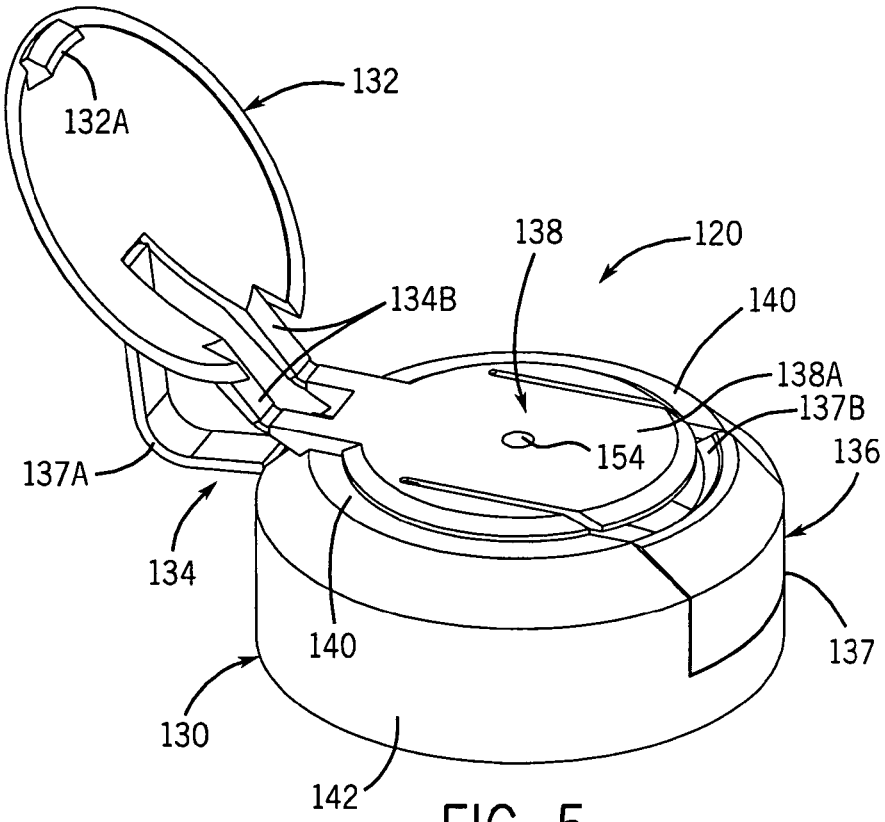
FIG. 5 is an isometric view of an alternate embodiment of the present dispensing actuator, with a flip-open lid thereof shown in an opened position.
Figure 6:
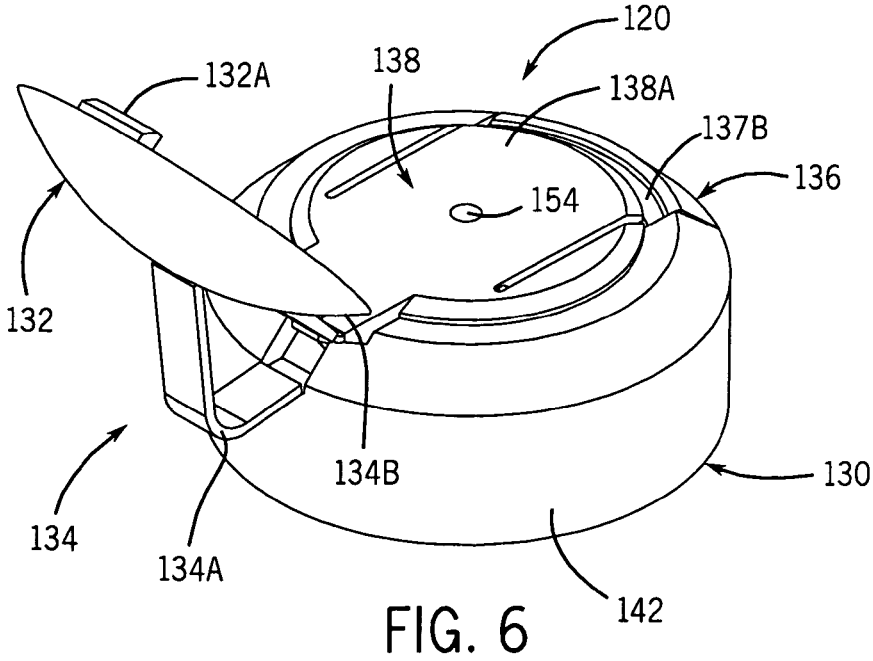
FIG. 6 is a further isometric view of this embodiment of the present dispensing actuator, shown from the opposite side thereof.
Figure 7:
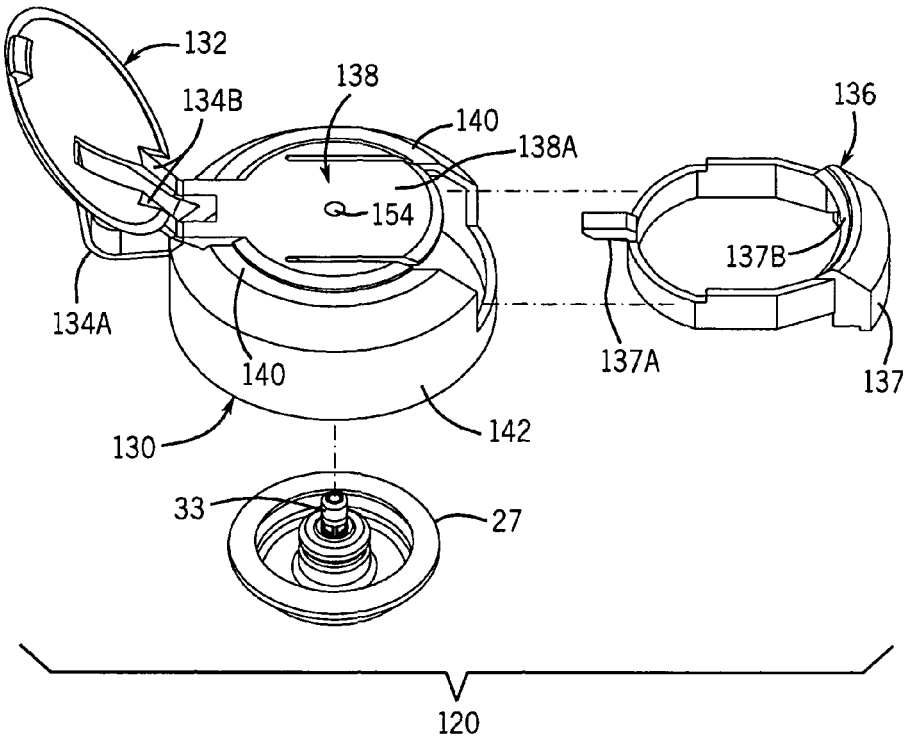
FIG. 7 is an exploded, isometric view of this embodiment of the present dispensing actuator shown in association with a dispensing valve and mounting cup of an associated container (not illustrated)

With particular reference to FIG. 4, the container 22 for which the present dispensing actuator is particular configured, includes a typically metallic side wall 23 which terminates in a rolled annular shoulder 25. The container further includes a mounting cup 27 fitted to the shoulder 25 with an aerosol dispensing valve 29 provided in the mounting cup 27.

The aerosol dispensing valve 29 may be of any suitable conventional or special type, with or without an associated dip tube (not shown) extending downwardly into the container. One conventional type of valve 29 is the vertical style, wherein the valve opens when the upper part of the valve is pushed inwardly (e.g., downwardly in FIG. 4) in accordance with the illustrated embodiment. Another conventional type of valve opens when an upper part of the valve is pushed so as to tilt the upper part of the valve relative to the mounting cup. The present invention can be adapted to function with either type of dispensing valve.

As illustrated, the dispensing valve 29 includes a valve body 31 that defines an interior chamber which has a bottom end that is open through a passage in the body 31 to the pressurized contents of the container 22. The container 22 typically holds a liquid product, or other fluent substance or product, which is pressurized by a propellant gas.

A compression coil spring 31B is disposed in the valve body 31, with an upwardly extending, product-dispensing valve stem 33 normally biased upwardly to the top of the valve body chamber by the spring. The valve body 31 defines suitable flow passages which extend from the bottom portion of the valve body and alongside the lower part of the valve stem 33. A gasket 31A is retained by the mounting cup 27 at the upper end of the valve body 31. The valve stem 33 includes a lateral inlet that is normally sealed closed by the gasket 31A and that communicates with a vertical internal outlet passage.

When the valve stem 33 is moved downwardly by operation of the associated dispensing actuator 20, as will be further described in detail, the valve stem 33 moves away from the gasket 31A, which becomes disengaged from its seated sealing relationship with the valve stem, and the pressurized fluent product can flow from the interior of the container 22 through the above-described passages of the valve body and valve stem. When the valve stem 33 is allowed to return to its elevated, closed position, under the influence of the biasing spring 31B, the flow passages are occluded by the gasket 31A, and the flow stops. As will be appreciated, the particular dispensing valve 29 (with or without a dip tube or suction tube, not shown) may be of any suitable design for dispensing a product from the container 22 and out through the valve stem 33. Thus, it will be understood that the dispensing actuator of the present invention is particularly configured for use with a dispensing valve having an outwardly projecting, moveable, product-dispensing valve stem that is normally biased from an actuated, opened dispensing position to a closed position.

While the illustrated dispensing valve is configured for operation by generally vertical, downward movements of the valve stem, generally inwardly toward the container 22 it will be understood that a dispensing actuator embodying the principles of the present invention can be readily configured for use with a container having a dispensing valve which operates by generally pivotal, angular movement of the valve stem, as known in the art.

With particular reference to FIGS. 1 to 4E, features of the present dispensing actuator 20 will now be described.

The General Arrangement of the Dispensing Actuator Components

As can be seen in FIG. 4, the presently most preferred form of the dispensing actuator 20 includes four basic components: (1) a unitary molded dispensing actuator body or base 30; (2) a lid 32, having a hinge 34 connecting the lid 32 to the base 30; (3) an opening element 36 that is slidable in the base 30; and (4) a movable or deflectable actuating element 38 unitarily mounted on, or connected with, the base 30. The opening element 36 may also be described as a "button," or a "sliding body" or a "slider."

In the preferred form of the embodiment of the invention, the lid 32 is provided to be closed over, and cover, the upper part of the dispensing actuator base 30, and to cover and enclose the actuating element 38 to prevent inadvertent actuation. The lid 32 can be moved to expose the actuating element 38 for dispensing. The lid 32 is movable between (1) a closed position over the base 30 and actuating element (as shown in FIGS. 2 and 4A-4D), and (2) an open position permitting access to the actuating element 38 (as show in FIGS. 1, 3, and 4). In the illustrated embodiment, the lid 32 is hinged to the base 30 so as to accommodate pivoting movement of the lid 32 between the closed position and the open position.

The Structure and Operation of the Components

In the preferred embodiment illustrated, the lid 32 may be characterized as including the hinge 34 which is connected to the dispensing actuator base 30. The hinge 34 is of the conventional snap-action type that may be conveniently molded from a suitable thermoplastic material to include two spaced-apart hinge portions 34A in the form of offset connecting spring links, and a film hinge 34B provided on the lid 32. One end of each link 34A is connected to the remaining portion of the lid 32 via a reduced thickness film hinge, and the other end is connected to the dispensing actuator base 30 via a reduced thickness film hinge.

The above-described snap-action hinge structure permits the lid 32 to be moved between the opened and closed positions because the links 34A deform elastically through a dead center position at which the links 34A are maximally deformed. On either side of the dead center position, the deformation of the links 34A is at least partly reduced, and the lid 32 is thus urged to a stable position at the end of its travel range on that side of the dead center position. Thus, when the lid 32 is in the closed position (FIG. 2), it is self-maintained in the closed position. On the other hand, when the lid 32 is open (FIGS. 1, 3, and 4), it is self-maintained in that position to accommodate dispensing of the contents without having to use one's fingers to hold the lid 32 out of the way. As will be noted, the lid 32 is arranged to move from a generally horizontal, closed position, to a generally vertical, opened position. Thus, the opened lid does not interfere with product being dispensed from the dispensing actuator generally between spring links 34A, as will be described.

Figure 3:
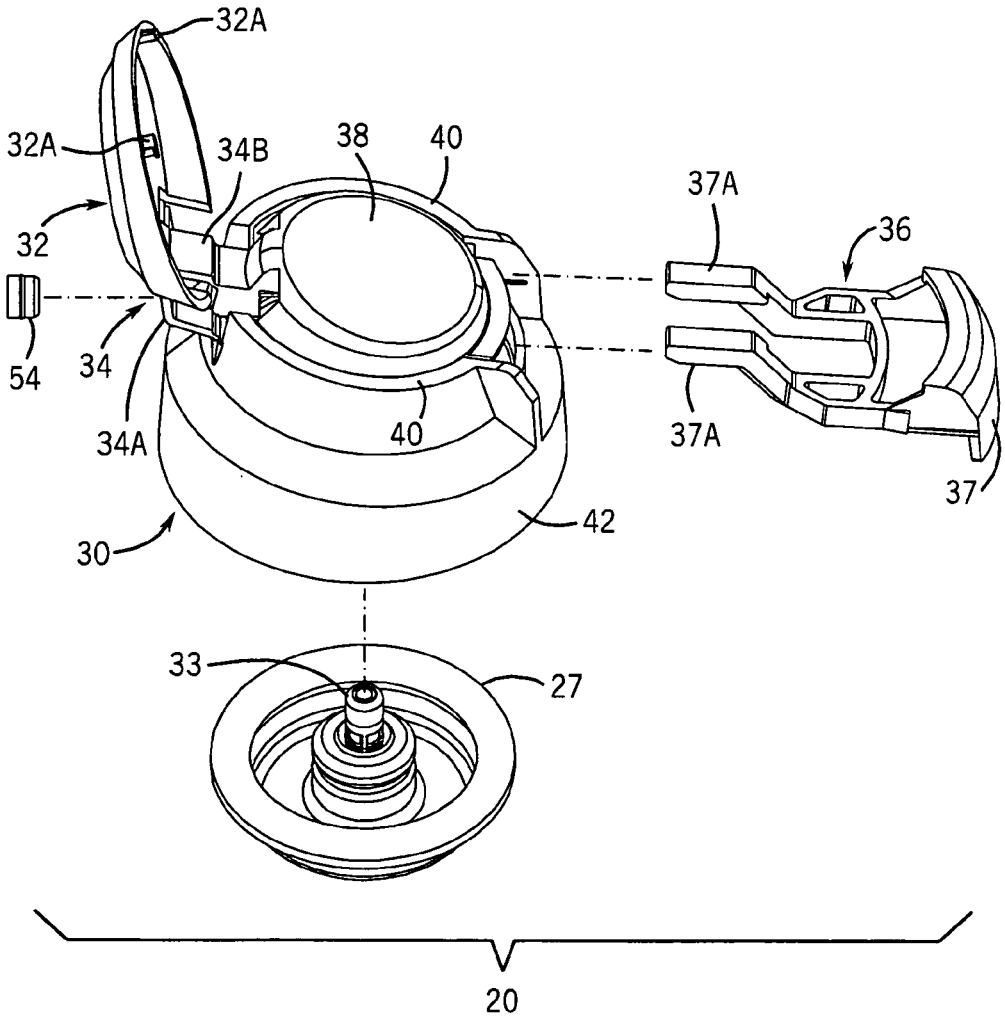
FIG. 3 is an exploded, isometric view of the present dispensing actuator, shown in association with a dispensing valve and the mounting cup of an associated container (not illustrated)

In the illustrated embodiment, the base 30 includes a generally annular deck having a pair of spaced-apart, deck portions 40 (FIG. 3). A skirt 42 extends downwardly on the dispensing actuator base 30 depending from the deck as shown in FIGS. 1 and 3. As can be seen in FIG. 4, an internal collar or internal skirt 44 is located within the skirt 42, and the collar 44 extends downwardly for engaging the container shoulder 25 when the dispensing actuator base 30 is mounted on the container 22 as shown in FIG. 4. The interior of the internal collar 44, is configured for snap-fit retention of the dispensing actuator on the shoulder 25 of container 22. Alternatively, the dispensing actuator base internal collar 44 could be provided with some other container connecting means, or could instead be permanently attached to the container 22 by suitable means.

While dispensing actuator base 30 has been illustrated as including a skirt 42, it will be understood that the provision of such a skirt can be optional, for decorative purposes. Thus, the dispensing actuator base can be configured without a skirt, per se, but with some other suitable mounting structure to facilitate fitment to an associated container.

The dispensing actuator base collar 44 may have any suitable configuration for accommodating the upwardly projecting shoulder 25 of the container 22 or for accommodating any other portion of a container received within the particular configuration of the dispensing actuator base internal collar 44—even if a container does not have a shoulder, per se. The main part of the container 22 may have a different cross-sectional shape than the container shoulder and dispensing actuator base internal collar 44. The dispensing actuator base internal collar 44 may be adapted for mounting to other types of fluent substance handling container systems (e.g., including dispensing apparatus, machines, or equipment). In the illustrated embodiment of the invention, the container neck receiving passage in the dispensing actuator base internal collar 44 has a generally cylindrical configuration, but includes an inwardly projecting bead 44A (FIG. 4) for snap-fit retention of the container 22.

As noted, convenient manipulation of lid 32 from its closed position to its opened position is effected by sliding, push-button movement of opening element 36 generally laterally of dispensing actuator base 30. In this embodiment, as best illustrated in FIG. 3, the opening element 36 has a generally bifurcated configuration, and includes a proximal, button portion 37, and a pair of distal pusher portions 37A generally opposite the proximal portion 37. The pusher portions 37A are respectively engageable with the spaced-apart hinge portions (i.e., spring links) 34A of lid 32. Thus, when the slider element 36 is in its first, closed position the hinged lid 32 can be positioned in its downward position, covering actuating element 38. When the opening element 36 is pushed generally inwardly of the dispensing actuator base 30 (to the left, referring to the orientation of FIGS. 4 and 4B), the pusher portions 37A respectively engage the hinge portions 34A thereby urging the lid 32 from its closed position to its opened position, with the action of the spring links urging the lid to its fully opened position as it goes "over center". Lid 32 is preferably provided with a pair of hook-like retention elements 32A, which are respectively engageable beneath the deck portions 40, acting to maintain the lid in a fully closed position (see FIGS. 4D and 4E). The lid 32 can be manipulated to this fully closed position, from its generally closed position, by downward finger pressure on the exterior of the lid.

The opening element 36 is positioned generally between the deck portions 40 of the dispensing actuator base 30 and extends inwardly of skirt 42 for lateral, sliding movement with respect thereto. The opening element 36 is retained in position within the dispensing actuator base 30 generally by the disposition of proximal portion 37, and distal pusher portions 37A, on generally upwardly facing surfaces 39, 39A of the dispensing actuator base 30 (see FIG. 4B). After molding of the separate components, the components can be readily assembled so that the opening element 36 is retained in operative association with the dispensing actuator base 30, and the assembly applied to an associated container.

While in the illustrated embodiment opening element 36 has been configured for generally linear, lateral movement, a dispensing actuator embodying the principles disclosed herein can be configured to include an opening element for otherwise effecting opening of the associated hinged lid, such as by linear, angular, twisting, or vertical movement of the opening element, as well as by combinations thereof.

In accordance with the present invention, selective actuation of the dispensing valve 29, for dispensing the fluent product within the associated contained 22, is effected by downward, resilient movement or deflection of the actuating element 38 with respect to the container 22, thereby moving valve stem 33 downwardly for actuation of the valve assembly, and dispensing a product. To this end, the actuating element 38 functions generally in the nature of a cantilevered beam, and is joined to the skirt 42 of the dispensing actuator base by a hinge region provided generally at that portion of the dispensing actuator base at which spring links 34A and hinge 34B are joined to the base. By this construction, the actuating element 38 is formed unitarily, i.e., as one piece, with the dispensing actuator base and thus its actuation is effected by generally flexing or deformation of the dispensing actuator base in the region of the hinge 34. The actuating element 38 is thus mounted for deflectable, generally hinging movement about an axis which is generally parallel to the hinging axis of the lid 32 of the dispensing actuator.

As illustrated in FIG. 4, the actuating element 38 defines a valve stem pocket 50 for receiving the valve stem 33 of dispensing valve 29 in substantially fluid-type sealing engagement therewith. As illustrated, the actuating element 38 of the dispensing actuator base further defines an internal passageway 52 that communicates with the valve stem pocket 50, and that can be joined in communication with the valve stem 33 in the valve stem pocket 50, so that upon actuation of the dispensing valve by deflection of the actuating element, the fluent product from with container 22 flows through the valve stem 33, and into the passageway 52 for dispensing of the product.

The product is dispensed from dispensing actuator 20 through a dispensing orifice 54 of the dispensing actuator. In this embodiment, the dispensing orifice 54 is provided in the form of a conventional mechanical break-up unit (MBU), which is fitted to the dispensing actuator base so that the dispensing orifice is joined in fluid communication with the passageway 52. Notably, the MBU is specially configured so that flow into the unit is by way of an annular passage, joined with passageway 52, with the MBU including suitable mechanical features to induce swirling, atomized spray of the fluent product being dispensed by the dispensing actuator. The MBU may be of any suitable conventional or special design, the details of which form no part of the present invention.

In this embodiment of the present dispensing actuator, the product is dispensed generally laterally of the dispensing actuator. To this end, the dispensing actuator preferably includes a hinge 34 configured to accommodate such lateral dispensing. In particular, the dispensing orifice 54 is positioned on the dispensing actuator base to direct the product being dispensed generally between the spaced-apart hinge elements i.e., spring links 34A. As will be appreciated, the bifurcated configuration of the opening element 36, including a pair of distal pusher portions 37A, accommodates this disposition and orientation of the dispensing orifice 54. The passageway 52 extends generally at a right angle to an axis defined by the product-dispensing stem 33, with downward, deflecting movement of the actuating element 38 thereby dispensing product generally at a right angle to, and laterally of, such downward movement, with the pusher portions 37A of opening element 36 generally positioned on respective opposite sides of the passageway 52.

From the foregoing description, operation of the dispensing actuator 20 will be readily appreciated. When fitted on the associated container 22, the dispensing actuator 20 receives the valve stem 33 within the valve stem pocket 50 in sealing relationship therewith. The dispensing actuator is securely retained in position on the container by the snap-fit of internal collar 44 on shoulder 25.

Lid 32 of the dispensing actuator is maintained in its closed position by engagement of retention elements 32A with the deck portions 40 of the dispensing actuator base 30. In this position of the lid, the actuating element 38 is shielded from inadvertent actuation, and thus the dispensing actuator container can be conveniently stored, handled, and shipped without inadvertent dispensing of the contents of the container.

Dispensing of the container's contents can be effected by grasping the container, and laterally pressing the proximal, button portion 37 of the opening element 36, urging the opening element laterally from its closed position toward its open position. Attendant to the sliding movement, the proximal, pusher portions 37A respectively act against the spring links 34A of the dispensing actuator hinge 34 thus urging the lid 32 towards its open position, in opposition to the spring links. By this action, the retention elements 32A are disengaged from the deck portions 40, and the lid is urged through its overcenter position to its fully open position, such as shown in FIG. 1.

The actuating element 38 of the dispensing actuator 20 is now exposed for convenient manipulation, and dispensing of the contents of the container. By downward deflection of the actuating element, the valve stem 33 is urged downwardly in opposition to the biasing spring 31B of the dispensing valve 29, and under the influence of the propellant within the container, the container's contents move upwardly through the dispensing valve body 31, and the valve stem 33. The fluent product thus flows into the dispensing actuator passageway 52, and is forcefully expelled through the dispensing orifice 54 defined by the mechanical break-up unit, with the dispensed product thus directed between the spring links 34A of the dispensing actuator hinge. As will be observed, the lid 32 is mounted in a fashion so that the lid does not interfere with the spray pattern of the dispensed product. As will be appreciated, manipulation of the dispensing actuator, including manipulation of the opening element 36, and depression of the actuating element 38, can be readily effected with one hand, as the container is grasped by a user.

After the desired quantity of product has been dispensed, the actuating element 38 is released, with its resilient nature resulting in generally upward movement of the actuating element. Such upward movement is further effected by the biasing spring 31B within the valve body 31 acting against the valve stem 33. Flow from within the container 22 is discontinued. The user can then conveniently move the lid 32 from its opened position to its closed position, whereupon retention elements 32A again respectively engage deck portions 40 to releaseably maintain the lid 32 in its closed position, and thus shield the actuating element 38 against inadvertent actuation.

Movement of lid 32 from its opened position to its closed position acts to move opening element 36 from its opened position back to its initial closed position as spring links 34A act against pusher portions 37A. As will be appreciated, the present dispensing actuator 20 can be opened, actuated, and subsequently closed, all by one-handed operation.

With reference now to FIGS. 5 to 8, therein is illustrated an alternate embodiment of the present dispensing actuator, designated 120, with elements like those in the previously-described embodiment identified by like reference numerals in the one-hundred series.

As in the previously described embodiment, dispensing actuator 120 can be configured for snap-fit securement to an associated container, such as container 22, for dispensing the pressurized contents of the container. As in the previous embodiment, dispensing actuator 120 includes a lid which is selectively moveable between opened and closed positions, and an actuating element which is accessible for actuation and dispensing of the container's contents when the lid is in an opened position. Push-button actuation of the lid facilitates convenient use by consumers. In distinction from the previous embodiment, wherein the contents of the container are dispensed generally laterally of the dispensing actuator, in this embodiment, the container's contents are dispensed generally upwardly, through a dispensing orifice provided in the dispensing actuator actuating element. Depending upon the specific application, this embodiment can be used when it is desirable to permit dispensing by inverting the dispensing actuator and container, and dispensing a product in a downward direction, such as for dispensing a hair care product.

In further reference to FIGS. 5 to 8, the dispensing actuator 120 illustrated therein includes a dispensing actuator base 130, a hingedly movable dispensing actuator lid 132, including a hinge 134, and a laterally moveable opening element 136 positioned generally within the dispensing actuator base 130. As in the previous embodiment, push-button actuation of the opening element 136, from a closed position to an opened position, acts to move lid 132 from its closed position to its opened position, with an over-center hinging movement.

The hinge 134 of dispensing actuator 120 differs from the previous embodiments, in that in this embodiment, a single spring link 134A is provided, operatively positioned between a pair of spaced-apart film hinges 134B. The lid may be provided with one or more hook-like retention elements 132A for cooperation with the actuating element 138 for releaseably retaining the lid 132 in its closed position. In the preferred embodiment, the opening element 136 defines a cam surface 137B engageable with the lid 132 in the closed position thereof, when the opening element 136 is moved from the closed position thereof toward the open position thereof.

Selective opening of the lid 132 is effected by lateral, sliding movement of opening element of 136. In distinction from the previous embodiment, opening element 136 has a generally ringed-shaped configuration (see FIG. 7), and includes a proximal, button portion 137 configured for manipulation to urge the opening element from its closed position towards its opened position. As illustrated, the opening element 136 includes a distal, pusher portion 137A, generally opposite the proximal portion 137, with the pusher portion engageable with the spring link 134A of hinge 134 as the opening element moves from its closed position to its opened position, to thereby move the lid 132 from its closed position toward the opened position thereof. By the provision of the cam surface 137B, the cam surface acts to urge the lid 132 from the closed position toward the opened position thereof prior to engagement of the pusher portion 136A with the lid 132. This initial movement of the lid by the cam surface 137B acts to unsnap and disengage the hook-like retention element 132A.

The dispensing actuator base 130 includes a deck including a pair of deck portions 140, with a skirt 142 depending downwardly from the deck. The dispensing actuator 120 may optionally include an internal collar for snap-fit securement of the dispensing actuator 120 to an associated container such as including the illustrated mounting cup 27 having a dispensing valve including a valve stem 33.

In accordance with the present invention, the dispensing actuator 120 includes a resiliently moveable, downwardly deflectable actuating element 138 provided on the dispensing actuator base 130 generally adjacent to the deck thereof. The actuating element 138 is accessible when the lid 132 is in its opened position, with the actuating element being resiliently deflectable, so that downward, deflecting movement of the actuating element operates the valve stem 33 of the dispensing valve to thereby permit dispensing of the fluent product within the associated container.

As in the previous embodiment, the actuating element 138 is generally configured in the nature of a cantilevered beam, for deflecting or hinging movement at a hinge region that can be provided by a thinned portion 138B (FIG. 8), generally adjacent hinge 134 of the dispensing actuator. The actuating element is thus moveable about an axis which is generally parallel to a hinging axis of the lid 132 provided by hinge 134.

In order to permit dispensing of the pressurized product from the associated container, the actuating element 138 defines a valve stem pocket 150 for receiving the valve stem 33 of the associated dispensing valve. Notably, in distinction from the previous embodiment, the dispensing orifice of this embodiment of the present dispensing actuator is provided in the actuating element itself, that is, the dispensing orifice 154 is provided in the actuating element 138, so that the contents of the associated container are dispensed generally upwardly (rather than generally laterally) of the dispensing actuator and container. Although not illustrated, a mechanical break-up unit (MBU) such as the MBU 54 shown in the previous embodiment, can be provided on actuating element 138 to define the desired dispensing orifice.

Figure 8:
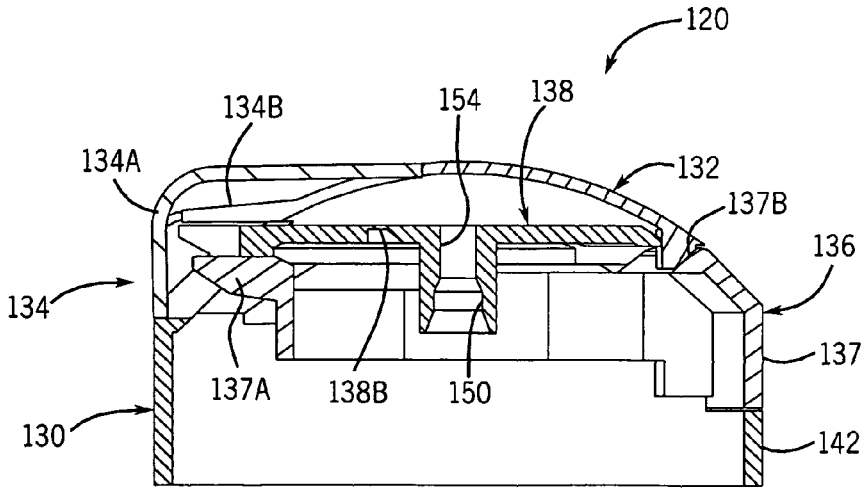
FIG. 8 is a cross-sectional view of this embodiment of the present dispensing actuator, with the flip-open lid thereof shown in a closed position prior to installation of the dispensing actuator on the dispensing valve and mounting cup of a container.
Figure 9:
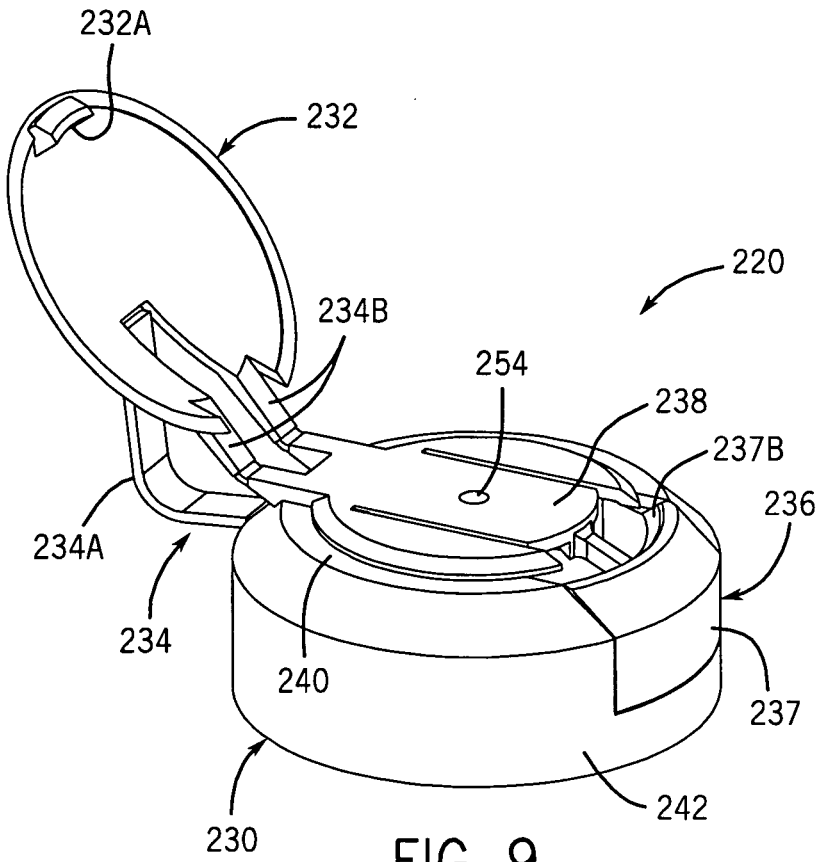
FIG. 9 is an isometric view of a further alternate embodiment of the present dispensing actuator, shown with a flip-open lid thereof in an opened position.
Figure 10:
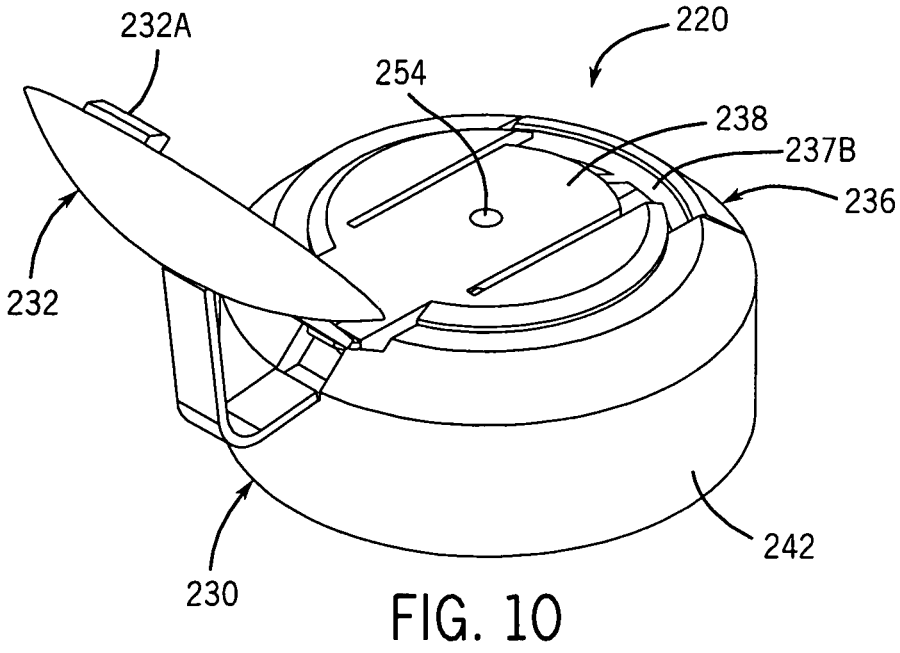
FIG. 10 is an isometric view of this embodiment of the present dispensing actuator, shown from an opposite side thereof.

Thus, the valve stem pocket 150 is in communication with the dispensing orifice 154, as illustrated in FIG. 8, so that downward, deflecting movement of the actuating element 138 acts to open the dispensing valve, and permit the flow of pressurized product from within the container and through the dispensing orifice.

Operation of this embodiment of the present invention is generally like that of the previously described embodiment. By selective manipulation of the opening element 136 from its closed position toward its opened position, the lid 132 is hingedly moved relative to the dispensing actuator base from its closed position to its over-center opened position. The actuating element 138 is thus uncovered, with the actuating element including a figure pad 138A (FIG. 5), generally between orifice 154 and the free end of the actuating element, which facilitates finger activation and manipulation of the actuating element to downwardly deflect the actuating element for dispensing the associated product. When dispensing is complete, the lid of the dispensing actuator can be moved back to its closed position, which movement acts against the opening element 136 to move it to its initial, closed position.

With reference now to FIGS. 9 to 12, therein is illustrated a further, alternate embodiment of the dispensing actuator of the present invention, designated 220. Elements of this embodiment of the present dispensing actuator that generally correspond to those elements of the previous embodiments are designated by like reference numerals in the two-hundred series. Like the previous embodiment, this embodiment of the present dispensing actuator is configured to dispense the pressurized contents of an associated container generally upwardly of the dispensing actuator, and to this end an actuating element of the dispensing actuator includes a dispensing orifice through which the contents are dispensed. In distinction from the previous embodiment, the actuating element of this embodiment includes a cam surface engageable by a opening element of the dispensing actuator assembly, which thus permits downward deflection of the actuating element to be effected by continued finger pressure on the opening element, after the opening element is initially moved to open the lid of the dispensing actuator. The dispensing actuator thus functions with a sequential opening/dispensing action The dispensing actuator 220 includes a dispensing actuator base 230, which can be configured for snap-fit securement to an associated container, such as including a mounting cup 27 and a valve stem 33 of an associated dispensing valve. The dispensing actuator 220 further includes a hingedly moveable lid 232, hingedly joined to the dispensing actuator base 230 by a hinge 234 of the lid. In this embodiment, the hinge 234 includes a single spring link 234A and a pair of spaced-apart hinged elements 234B. For releasably retaining the lid in its closed position, the lid 232 can include at least one retention element 232A which cooperates with the actuating element 238. In the preferred form, the opening element 236 defines a cam surface 237B engageable with the lid 232 in the closed position thereof for initially moving the lid out of its closed position.

Figure 11:
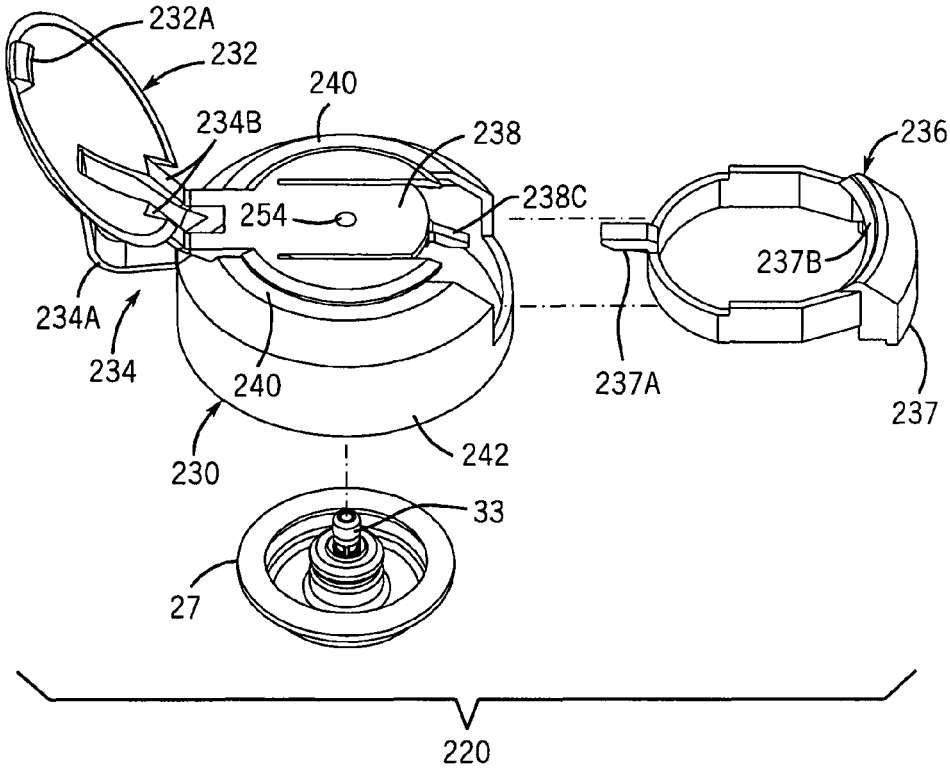
FIG. 11 is an exploded, isometric view of this embodiment of the present dispensing actuator shown in association with a dispensing valve and mounting cup of an associated container (not illustrated)

Operation of the dispensing actuator is effected by the provision of a generally laterally moveable opening element 236, which in this embodiment has a generally ring-shaped configuration (see FIG. 11). The opening element 236 includes a proximal, button portion 237, and a distal, pusher portion 237A, positioned generally opposite the proximal portion 237. The pusher portion 237A is engageable with the spring link 234A of the hinge 234, whereby lateral sliding movement of the opening element 236 from its closed position toward its open position acts to move the lid 232 from its closed position to its over-center opened position. By the action of cam surface 237B on the lid 232, the cam surface acts to initially move the lid from its fully closed position, and disengage the retention element 232A from the actuating element 238, prior to pusher portion 237A acting on spring link 234A to open the lid. As will be appreciated, there can be some engagement of the opening element with the cam surface 238C as the pusher portion 237A acts to open the lid, but such downward movement of the actuating element is not sufficient to actuate the associated dispensing valve.

The dispensing actuator base 230 includes a deck including deck portions 240 and a depending annular skirt 242 depending from the deck of the dispensing actuator base. The opening element 236 is positioned generally within the dispensing actuator base beneath the deck thereof.

Figure 12:
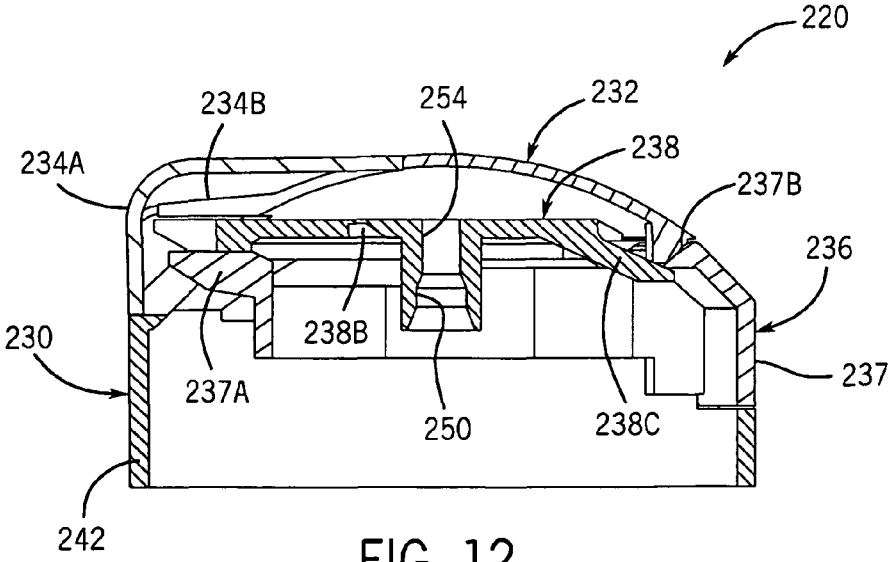
FIG. 12 is a cross-sectional view of this embodiment of the present dispensing actuator, showing the flip-open lid thereof in a closed position prior to installation of the dispensing actuator on the dispensing valve and mounting cup of a container.

With reference to FIG. 12, the actuating element 238 functions generally in the nature of a cantilevered beam, and is generally hingedly moveable about a hinge region that can be provided by a thinned portion 238B (FIG. 12), generally adjacent hinge 234 of the dispensing actuator, so that the actuating element is hingedly moveable about an axis which is generally parallel to the axis about which lid 232 moves relative to dispensing actuator base 230.

The actuating element 238 defines a valve stem pocket 250 which receives the valve stem 33 of the valve of the associated container. The actuating element 238 further includes a dispensing orifice 254 which communicates with the valve stem pocket 250. Downward deflection of the actuating element acts against the valve stem to open the associated dispensing valve, whereby the contents of the associated container are dispensed generally upwardly through the actuating element, out of the a dispensing orifice 254. If desired, a mechanical break-up unit (MBU) can be provided on the actuating element to define the dispensing orifice.

Downward deflection of the actuating element 238 is effected by the provision of a cam surface 238C which extends generally from the deflectable, free end of the actuating element 238. The cam surface 238C is engageable by the inside surface of the proximal portion 237 of the opening element 236, as the opening element is moved from its closed position into its opened position. By this lateral sliding movement, the lid 232 is first moved from its closed position to its opened position, with continued pressure on proximal portion 237 urging the opening element 236 laterally, whereby engagement with actuating element cam surface 238C is effected, to thereby move and deflect the actuating element 238 downwardly for operation of the associated dispensing valve. As in the previous embodiment, the contents of the container are thus dispensed generally upwardly of the dispensing actuator, through the dispensing orifice 254.

While the present dispensing actuator has been shown in a configuration for operative connection with an outwardly projecting valve stem of an associated dispensing valve, the present actuator can be configured, such as by the provision of a downwardly deflectable conduit, for operation of a female dispensing valve, which has no outwardly extending valve stem.

In one illustrated embodiment of the present dispensing actuator, the dispensing orifice of the actuator is uncovered, even before the lid of the actuator is opened for subsequent dispensing of the contents of the associated container. In alternate embodiments, the dispensing orifice of the actuator is covered by the lid of the actuator until the lid is opened, and the actuator operated for dispensing the container's contents. It will thus be appreciated that a dispensing orifice of the dispensing actuator embodying the principles of the present invention can be either uncovered or covered, prior to opening and use of the actuator.

It will be readily observed from the foregoing detailed description of the invention and from the illustrated embodiments thereof that numerous other variations and modifications may be effected without departing from the true spirit and scope of the novel concepts or principles of this invention.

What is claimed is:

1. A dispensing actuator for a container that has a dispensing valve for dispensing a fluent product, wherein the dispensing valve is normally biased from an actuated, open dispensing position to a closed position, said dispensing actuator comprising:

a dispensing actuator base for extending from said container at said dispensing valve;

a lid including a hinge connecting said lid with said dispensing actuator base to accommodate movement of said lid between: (1) a closed position, and (2) an opened position to permit the dispensing of a product from said container;

an opening element mounted on said dispensing actuator base for linear movement with respect thereto from a closed position to an opened position, said opening element being engageable with said lid, so that generally lateral movement of said opening element from said closed position to said opened position moves said lid from said closed position thereof toward said opened position thereof; and an actuating element on said dispensing actuator base, said actuating element being accessible when said lid is in said opened position thereof, said actuating element being resiliently deflectable, so that downward, deflecting movement of said actuating element operates said dispensing valve to thereby permit dispensing of the fluent product within said container through a dispensing orifice defined by said dispensing actuator;

said opening element includes a proximal, button portion configured for manipulation to urge said opening element from said closed position toward said opened position thereof, said opening element including at least one distal, pusher portion, generally opposite said proximal portion, engageable with said lid as said opening element moves from said closed position to said opened position to move said lid from the closed position thereof toward the opened position thereof;

said pusher portion being positioned in fixed relationship with respect to said proximal portion for linear movement with said proximal portion as said opening element is moved linearly with respect to said dispensing actuator base; wherein said hinge for said lid of said dispensing actuator includes a pair of spaced-apart hinge elements, said dispensing orifice being positioned on said dispensing actuator base to direct the substance being dispensed generally between said hinge elements; said opening element includes a pair of distal, pusher portions respectively engageable with said pair of hinge elements.

2. The dispensing actuator in accordance with claim 1 for use with a container that has an annular shoulder, and a mounting cup secured to said annular shoulder, said dispensing valve being mounted on said mounting cup, said dispensing valve being either a separate non-pump valve or a valve defined by or within a pump;

said dispensing actuator being separate from, but attachable to, said annular shoulder of said container by a snap-fit so that said actuating element is operatively engageable with said dispensing valve.

3. The dispensing actuator in accordance with claim 1, wherein:

said dispensing actuator base includes a deck, said opening element being positioned generally beneath said deck of said dispensing actuator base.

4. The dispensing actuator in accordance with claim 3, wherein:

said opening element has a generally bifurcated configuration.

5. The dispensing actuator in accordance with claim 1, wherein:

said actuating element is connected with said dispensing actuator base by a hinge region for deflectable, generally hinging movement of said actuating element about an axis which is generally parallel to a hinging axis of said lid of said dispensing actuator.

6. The dispensing actuator in accordance with claim 1, wherein:

said actuating element defines an internal passageway that communicates with said dispensing orifice, and that can be joined in fluid communication with said valve, so that upon actuation of said dispensing valve by deflection of said actuating element, the fluent product within the container flows through said valve and into said passageway for dispensing out of said dispensing orifice.

7. The dispensing actuator in accordance with claim 6, wherein:

said dispensing valve includes an outwardly projecting, movable, product-dispensing valve stem, said passageway extending generally at a right angle to an axis defined by said product-dispensing valve stem.

8. The dispensing actuator in accordance with claim 7, wherein:

said hinge for said lid of said dispensing actuator includes a pair of spaced-apart hinge elements, said dispensing orifice being positioned on said dispensing actuator base to direct the product being dispensed generally between said hinge elements.

9. The dispensing actuator in accordance with claim 1, wherein:

said actuating element includes said dispensing orifice, so that downward deflection of said actuating element dispenses said product through said actuating element.

10. The dispensing actuator in accordance with claim 9, wherein said actuating element includes a finger pad for manipulation to downwardly deflect the actuating element for dispensing the product.

11. A dispensing actuator for a container within which a fluent substance may be stored, said container having an annular shoulder, and a mounting cup secured to said annular shoulder, said container including a dispensing valve mounted on said mounting cup, the dispensing valve including an outwardly projecting, movable, product-dispensing valve stem that is normally biased from an actuated, open dispensing position to a closed position, said dispensing actuator comprising:

a dispensing actuator base for extending from said container at said dispensing valve, said dispensing actuator base having (1) a deck, and (2) a skirt depending from said deck for snap-fitment to said annular shoulder of said container;

a lid including a hinge connecting said lid with said dispensing actuator base to accommodate movement of said lid between: (1) a closed position, and (2) an opened position to permit the dispensing of a substance from said container;

said hinge including at least one spring element extending between said lid and dispensing actuator base for biasing the movement of said lid with respect to said dispensing actuator base; and an opening element mounted on said dispensing actuator base, generally beneath said deck and extending inwardly relative to said skirt, for generally lateral movement with respect to said dispensing actuator base, said opening element being movable generally laterally of said dispensing actuator base from a closed position to an opened position, said opening element including a proximal, button portion configured for manipulation to urge said opening element from said closed position toward said opened position thereof, said opening element including at least one distal, pusher portion, generally opposite said proximal, button portion in fixed relationship for movement therewith, said pusher portion being engageable with said hinge as said opening element moves from said closed position to said open position to move said lid from the closed position thereof toward the opened position thereof; and an actuating element unitarily connected with said dispensing actuator base generally adjacent to said deck, said actuating element defining a valve stem pocket for receiving said valve stem when said dispensing actuator is mounted on said container, said actuating element being accessible when said lid is in said opened position thereof, said actuating element being resiliently deflectable, so that downward, deflecting movement of said actuating element operates the stem of said dispensing valve to thereby permit dispensing of the fluent substance within said container through a dispensing orifice defined by said dispensing actuator; wherein said at least one spring element includes a pair of spaced-apart hinge elements, said dispensing orifice being positioned on said dispensing actuator base to direct the substance being dispensed generally between said hinge elements; said opening element includes a pair of distal, pusher portions respectively engageable with said pair of hinge elements.

12. The dispensing actuator in accordance with claim 11, wherein:

said actuating element defines an internal passageway that communicates with said valve stem pocket and said dispensing orifice, said passageway extending at generally a right angle to an axis defined by said product-dispensing stem, so that upon actuation of said dispensing valve by deflection of said actuating element, the fluent substance within the container flows through valve stem and into said passageway for dispensing out of said dispensing orifice.

13. The dispensing actuator in accordance with claim 11, wherein:

said actuating element includes said dispensing orifice, with said valve stem pocket communicating with said dispensing orifice, so that actuation of said valve by manipulation of said actuating element dispenses said substance through said actuating element.

14. The dispensing actuator in accordance with claim 13, wherein:

said actuating element defines a finger pad for manipulation to downwardly deflect the actuating element for dispensing the product.

15. A dispensing actuator for a container that has a dispensing valve for dispensing a fluent product, wherein the dispensing valve is normally biased from an actuated, open dispensing position to a closed position, said dispensing actuator comprising:

a dispensing actuator base for extending from said container at said dispensing valve;

a lid including a hinge connecting said lid with said dispensing actuator base to accommodate movement of said lid between: (1) a closed position, and (2) an opened position to permit the dispensing of a product from said container;

an opening element mounted on said dispensing actuator base for movement with respect thereto from a closed position to an opened position, said opening element being engageable with said lid, so that generally lateral movement of said opening element from said closed position to said opened position moves said lid from said closed position thereof toward said opened position thereof;

an actuating element on said dispensing actuator base, said actuating element being accessible when said lid is in said opened position thereof, said actuating element being resiliently deflectable, so that downward, deflecting movement of said actuating element operates said dispensing valve to thereby permit dispensing of the fluent product within said container through a dispensing orifice defined by said dispensing actuator; and said opening element includes a proximal, button portion configured for manipulation to urge said opening element from said closed position toward said opened position thereof, said opening element including at least one distal, pusher portion, generally opposite said proximal portion, wherein said pusher portion is guided for only linear movement and has a configuration which is undeformed when said lid is in said closed position and when said lid is in said opened position, and wherein said pusher portion is engageable with said lid as said opening element moves from said closed position to said opened position to move said lid from the closed position thereof toward the opened position thereof; wherein said hinge for said lid of said dispensing actuator includes a pair of spaced-apart hinge elements, said dispensing orifice being positioned on said dispensing actuator base to direct the substance being dispensed generally between said hinge elements; said opening element includes a pair of distal, pusher portions respectively engageable with said pair of hinge elements.

* * * * *